US010894203B2

(12) United States Patent
Conte et al.

(10) Patent No.: US 10,894,203 B2
(45) Date of Patent: Jan. 19, 2021

(54) GAME DEVICE EQUIPPED WITH MODIFIED CYLINDER FOR AUTONOMOUSLY MANAGING A FAVOURABLE EVENT

(71) Applicant: JJ Gaming S.r.l., Campione d'Italia (IT)

(72) Inventors: Pierangelo Conte, Sondrio (IT); Bruno Toini, Campione d'Italia (IT); Christian Toini, Campione d'Italia (IT)

(73) Assignee: JJ Gaming S.r.l., Campione d'Italia (IT)

( * ) Notice: Subject to any disclaimer, the term of this patent is extended or adjusted under 35 U.S.C. 154(b) by 567 days.

(21) Appl. No.: 15/572,241

(22) PCT Filed: May 18, 2016

(86) PCT No.: PCT/IT2016/000128
§ 371 (c)(1),
(2) Date: Nov. 7, 2017

(87) PCT Pub. No.: WO2016/185501
PCT Pub. Date: Nov. 24, 2016

(65) Prior Publication Data

US 2018/0140939 A1 May 24, 2018

(30) Foreign Application Priority Data

May 19, 2015 (IT) ..... UB2015A0749

(51) Int. Cl.
*A63F 5/00* (2006.01)

(52) U.S. Cl.
CPC ..... *A63F 5/007* (2013.01); *A63F 2250/609* (2013.01)

(58) Field of Classification Search
USPC ..... 273/142 C
See application file for complete search history.

(56) References Cited

U.S. PATENT DOCUMENTS 5,553,851 A * 9/1996 Malavazos ..... A63F 5/02 273/115
5,755,440 A * 5/1998 Sher ..... A63F 5/00 273/142 E (Continued)

FOREIGN PATENT DOCUMENTS

EP 1287861 A1 3/2003
EP 1627670 A2 2/2006

(Continued)

OTHER PUBLICATIONS

International Search Report for the International Application No. PCT/IT2016/000128 dated Oct. 6, 2016.

*Primary Examiner* — John E Simms, Jr.
*Assistant Examiner* — Dolores R Collins
(74) *Attorney, Agent, or Firm* — Kelly & Kelley, LLP

(57) ABSTRACT

A game device (1) is described, of the type which comprises a first moving part (2*b*), equipped with a plurality of numbered sectors or boxes (9), adapted to receive a ball (5), the first moving part (2*b*) rotating inside a second fixed part (2*a*), so that, by placing the ball (5) on a track (6) of the second fixed part (2*a*) and by launching it towards the first moving part (2*b*), the ball (5) ends its travel in one of the numbered boxes (9), thereby determining a winning number; the game device (1) has means adapted to determine at least one other stop position of the ball (5), inside the numbered boxes (9). A method is also described, for increasing the number of possible results which can be obtained with this game device (1).

23 Claims, 14 Drawing Sheets

(56) References Cited

U.S. PATENT DOCUMENTS

| | | | | |
|---|---|---|---|---|
| 7,926,808 | B1 * | 4/2011 | Gullotta | A63F 5/007 273/142 F |
| 7,988,548 | B2 * | 8/2011 | Okada | G07F 17/3286 463/17 |
| 8,152,170 | B2 * | 4/2012 | Yokota | A63F 5/00 273/138.1 |
| 8,684,359 | B2 * | 4/2014 | Kang | A63F 5/045 273/142 J |
| 9,895,602 | B2 * | 2/2018 | Hendon | A63F 5/007 |
| 10,226,690 | B2 * | 3/2019 | Adams | A63F 5/007 |
| 10,475,277 | B2 * | 11/2019 | Reeves | G07F 17/326 |
| 2006/0009274 | A1 * | 1/2006 | Finocchio | G07F 17/32 463/17 |
| 2007/0120320 | A1 | 5/2007 | Miltenberger et al. | |
| 2009/0283967 | A1 * | 11/2009 | Stergides | G07F 17/32 273/142 E |
| 2013/0053119 | A1 * | 2/2013 | Sharoni | G07F 17/322 463/17 |
| 2013/0127112 | A1 | 5/2013 | Kogure et al. | |
| 2013/0249167 | A1 * | 9/2013 | Luck | A63F 5/00 273/142 E |
| 2016/0263472 | A1 * | 9/2016 | Chavez-Munoz | G07F 17/3213 |
| 2017/0087450 | A1 * | 3/2017 | Mercer | A63F 5/00 |
| 2019/0209916 | A1 * | 7/2019 | Adams | A63F 5/02 |

FOREIGN PATENT DOCUMENTS

| | | | |
|---|---|---|---|
| GB | 931058 | A | 7/1963 |
| KR | 100846303 | B1 | 7/2008 |

* cited by examiner (a)

(b) (c)

(a)

(b) (c)

(a)

(b) (c)

GAME DEVICE EQUIPPED WITH MODIFIED CYLINDER FOR AUTONOMOUSLY MANAGING A FAVOURABLE EVENT

BACKGROUND OF THE INVENTION

1) Field of the Invention

The present invention relates to the field of game devices and refers to a method and to a device for performing such method, to increase the number of possible results, without changing the procedure of the game itself. The invention applies in particular to games which use a cylinder, for example a roulette.

2) Background Art

The main games which use a cylinder are three, namely the French roulette, the English or European roulette and the American roulette.

The French roulette, with numbers from 0 to 36, is different from the other two games due to the sizes of the table where two-three employees are seated and due to the procedure in case number zero appears; in this situation, in fact, the bets on simple chances (red/black, even/odd, manque/passe) are trapped up to the appearance of the following number, when they are freed again or cashed by the bench.

In the English or European roulette with numbers from 0 to 36, but with a smaller game table, the game is managed by a single employer only and, in case number zero appears, bets on simple chances are immediately halved.

The American roulette is characterized by a different cylinder from the two previous ones and, in addition to numbers from 0 to 36 arranged completely differently, has a thirty-eighth box called double zero (00) placed in a diametrically opposite position with respect to the zero: when number zero appears, simple chances lose.

In the three above described games, the cylinder is composed of a fixed part with a concave shape equipped with a launch path for a ball which, due to the force of gravity, will move on a spiral-shaped trajectory towards a central moving disk, divided into 37 or 38 numbered sectors, equipped with as many boxes adapted to house the ball, the disk being rotating around a vertical axis.

Various factors affect the ball path, among which the force of gravity and the centrifugal force, the presence of lozenge-shaped obstacles, the different speed impressed by those who launch the ball, the rotation speed of the central disk, the wear of the game instruments and the change of temperature and humidity degree. Such elements make the appearance of a number totally random.

The chance that an event occurs is given by the number of favourable events divided by the possible cases. In the roulette game, it is given by a favourable event divided by the 37 or 38 possible events. Therefore, it results that the chance that the ball stops in a certain box is of 1 out of 37 or 1 out of 38.

The problem of overcoming a constraint due to a limited number of available arrival boxes also poses itself in virtual games, in which a pointer, for example a ball displayed on a monitor, at the end of the path, also virtual, towards a plurality of prearranged areas, stops on one of these areas, determining the game result, the result being, also in this case, completely random.

SUMMARY OF THE INVENTION

Object of the present invention is overcoming the constraint due to the limited number of arrival boxes, and has been obtained through the use of a method and of a device for performing such method, respectively according to claims 1 and 2.

It is intended that all enclosed claims are an integral part of the present description.

The method for increasing the number of possible results which can be obtained with a game device, wherein a pointer, for example a real or virtual ball, at the end of a path, also real or virtual, towards a plurality of prearranged areas to house the pointer, occupies one of these areas, thereby determining a result, is characterized by adding, inside these areas, well defines and identifiable positions in which this pointer can end its stroke, this increase of the number of positions being obtained without affecting the movements of the pointer and the way of stopping in one of the areas, preserves the characteristics and the philosophy of the game.

In practice, the change of probability occurs when the pointer, dropped into one of the areas, having already determined the winning number, finds inside the area itself at least two well defined and identifiable spots where it can stop. The stop of the pointer in one of these further drop spots can increase or decrease the advantages deriving from the appearance of the number or create an independent game situation.

The game device according to the invention comprises a first moving part, equipped with a plurality of numbered sectors or boxes adapted to receive a ball, which rotates inside a second fixed part, so that by placing the ball on a track of the second fixed part and launching it towards the first moving part, the ball ends its travel in one of these numbered boxes, thereby determining the winning number, and is characterized in that it provides for means adapted to determine at least one other stop position of the ball, inside the numbered boxes.

According to a preferred embodiment, these means, adapted to determine at least one other stop position of the ball inside the numbered boxes, comprise a suitable shaping of the boxes.

According to another preferred embodiment, the means, adapted to determine at least one other stop position of the ball inside the numbered boxes, comprise suitably shaped inserts, adapted to be inserted in each of the numbered boxes.

According to the result to be obtained, it is possible to replace the inserts inside the boxes with other ones having different characteristics, or to modify the surfaces of the boxes.

Synthetically, the present invention consists in placing inserts inside the existing boxes or in shaping the boxes in order to obtain different areas inside the box in which the ball can stop.

When actuating the invention, one introduces a plurality of different results, making the game more various and interesting, without minimally modifying its conduction. Should the modification be introduced by using inserts, it is possible to extremely easily intervene on existing devices, by providing suitable transforming kits.

BRIEF DESCRIPTION OF THE DRAWINGS

The invention will now be described, as a non-limiting example, according to a preferred embodiment thereof and with reference to the enclosed drawings, in which.

DETAILED DESCRIPTION OF PREFERRED EMBODIMENTS

Figure 1:
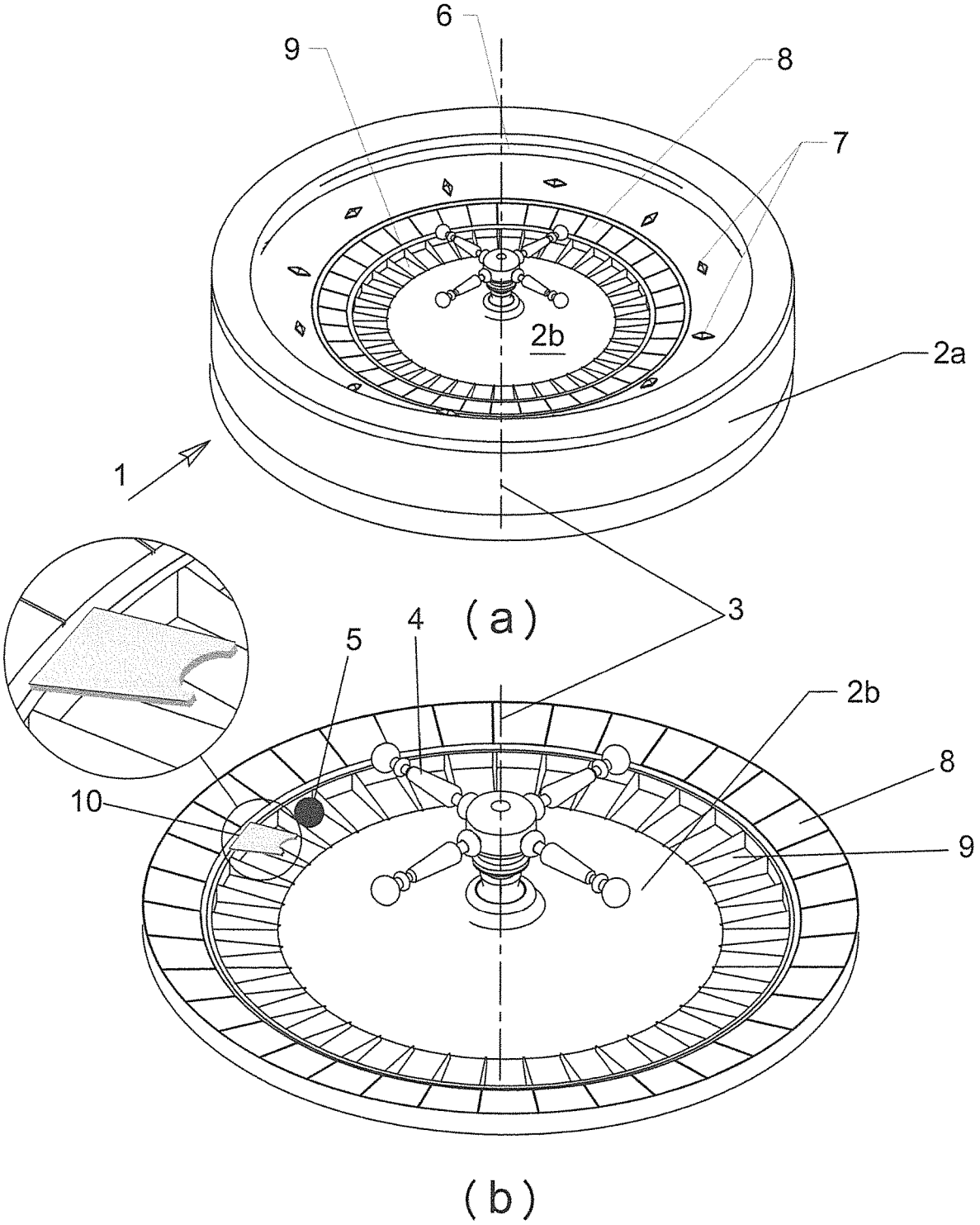
FIGS. 1 (*a, b*) show the cylinder of a roulette with an insert according to the invention.
Figure 2:
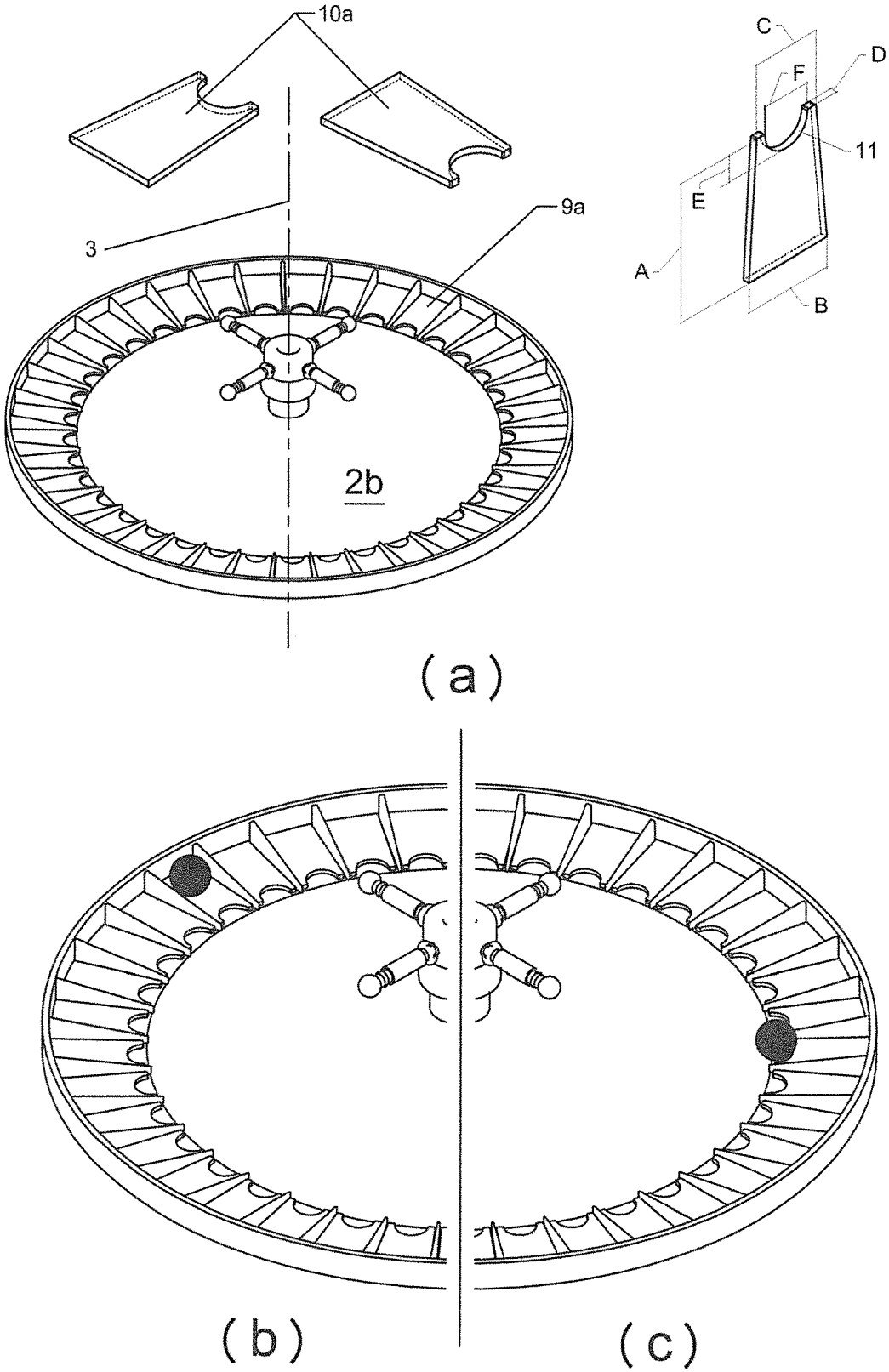
FIGS. 2 to 13 show inserts and shaped boxes in order to obtain different areas inside the box in which the ball can stop.
Figure 3:
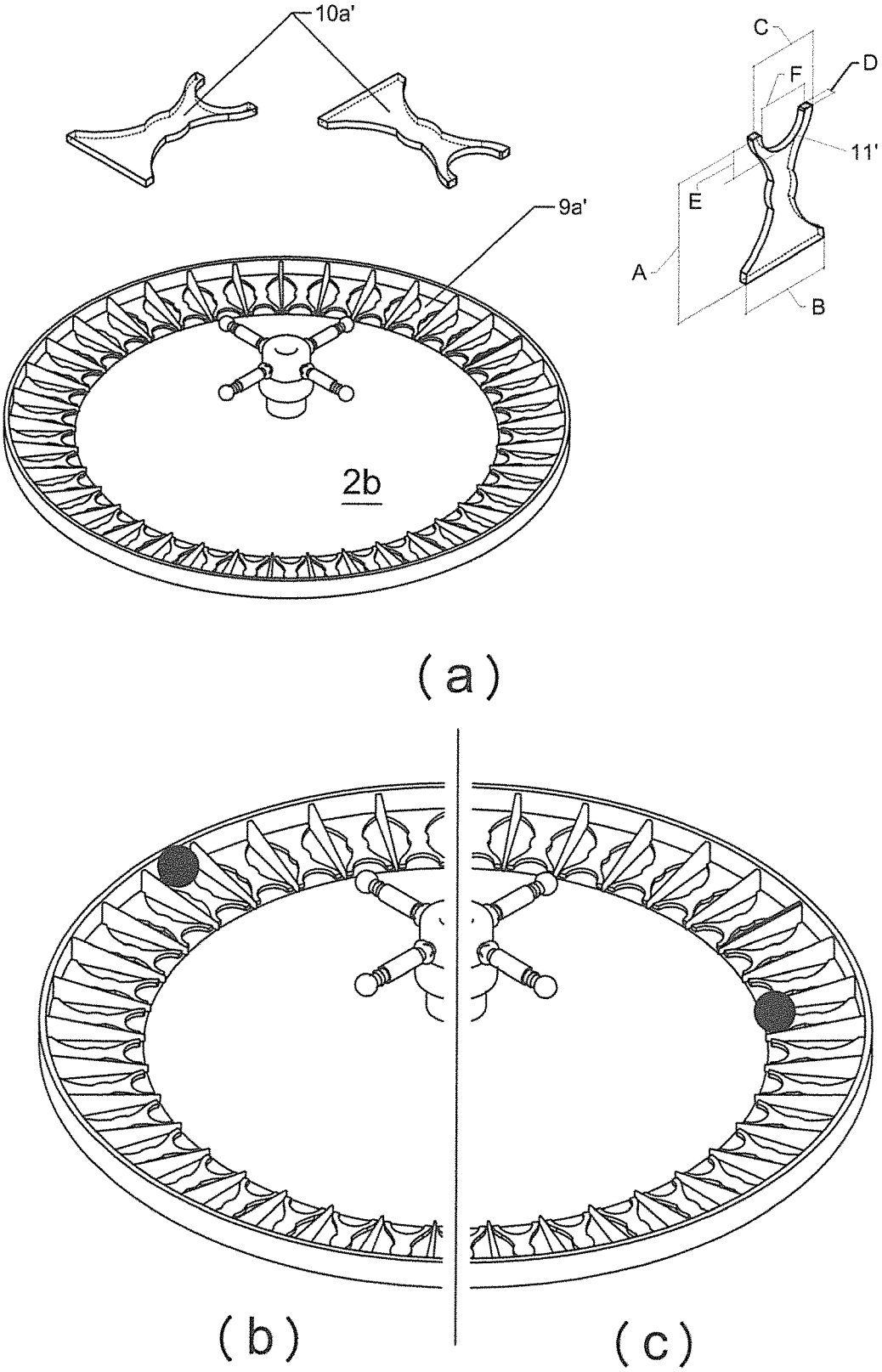
Figure 4:
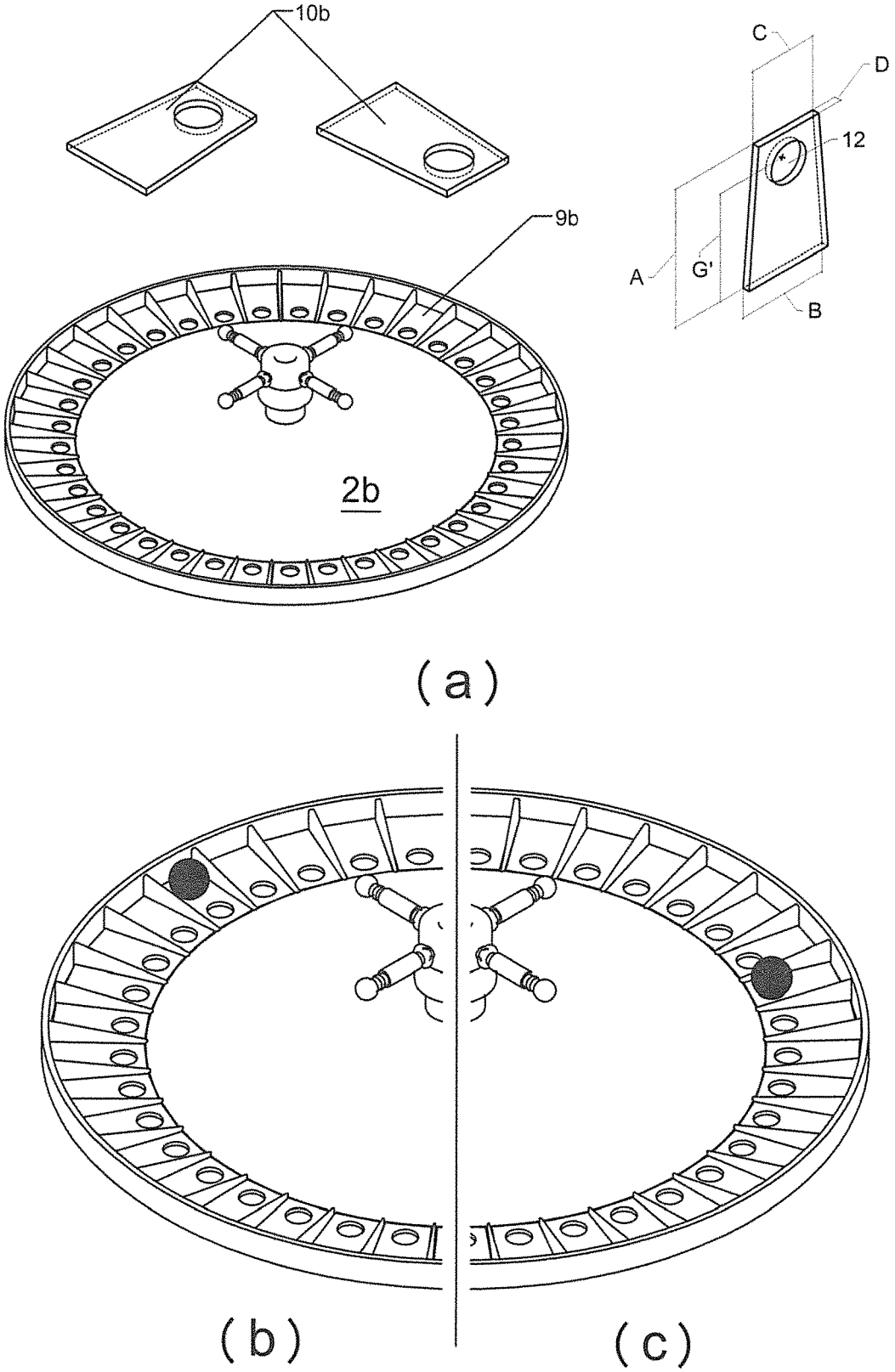
Figure 5:
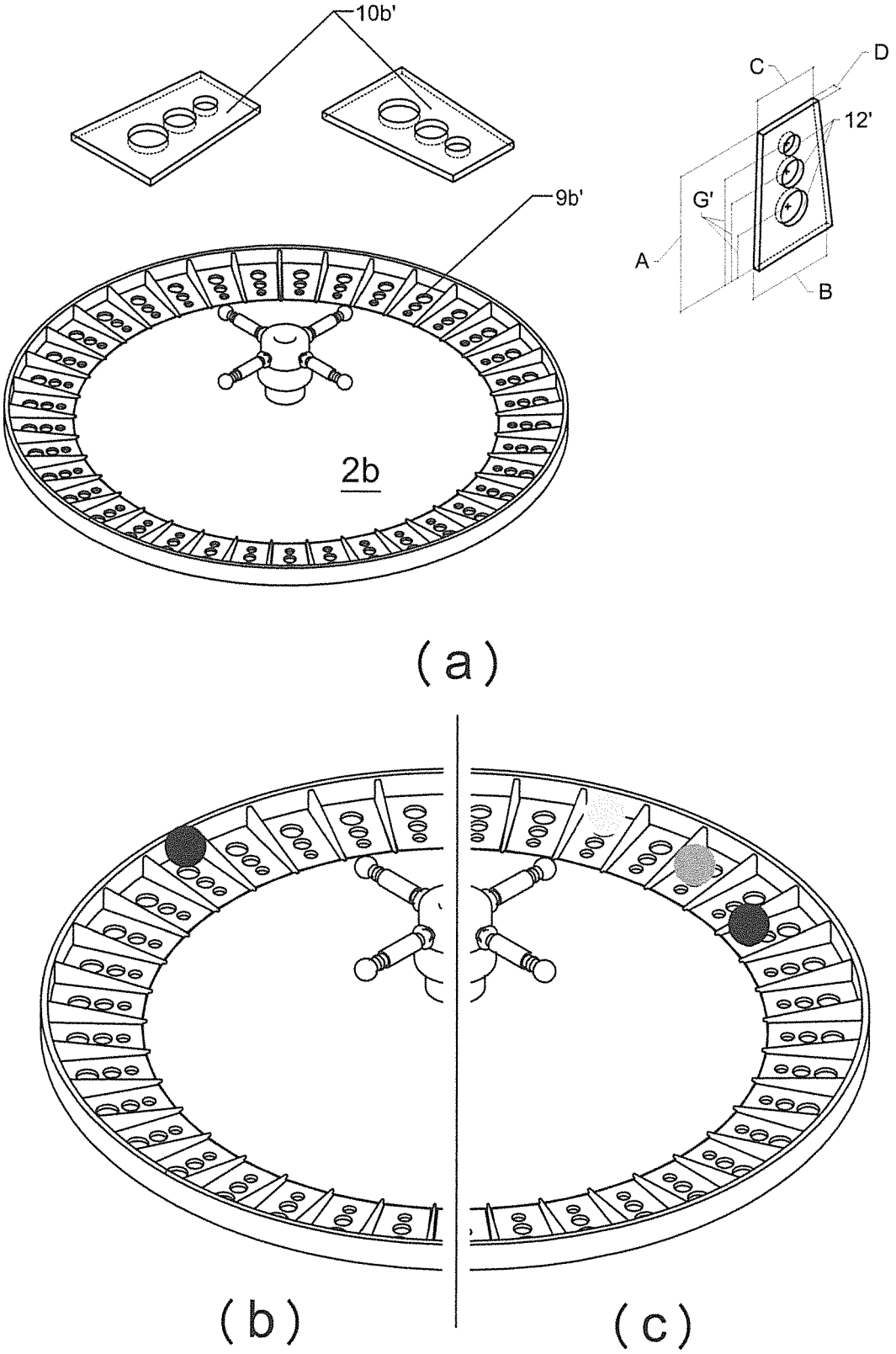
Figure 6:
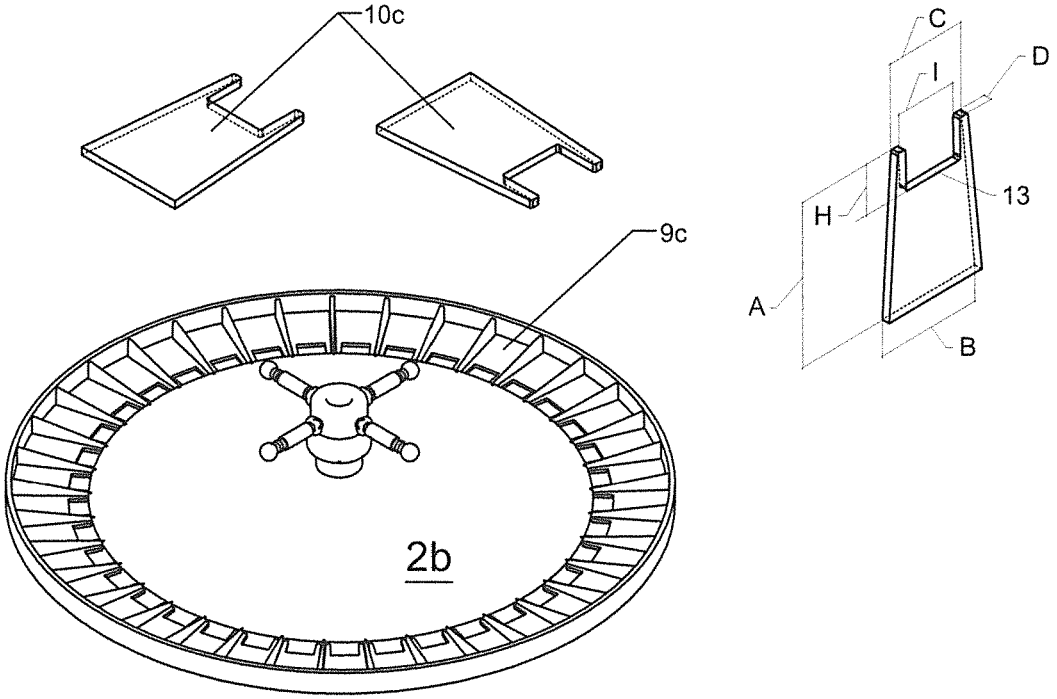
Figure 6:
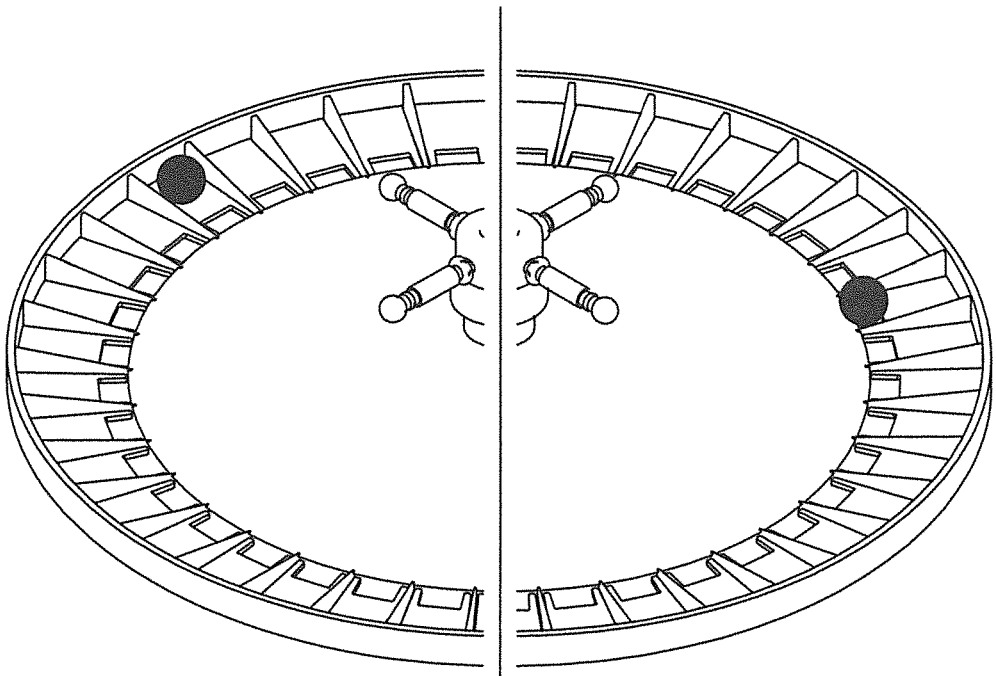
Figure 7:
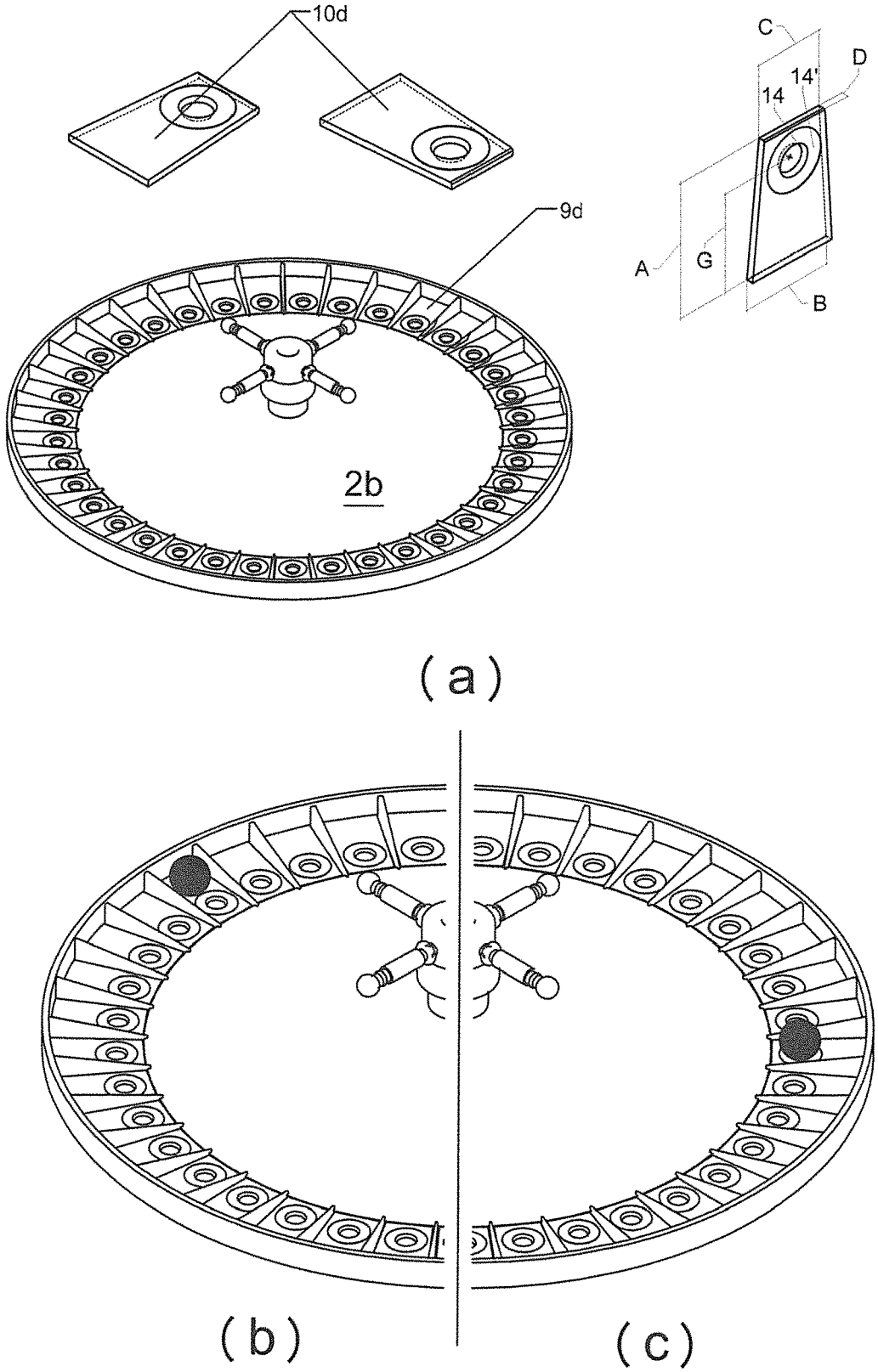
Figure 8:
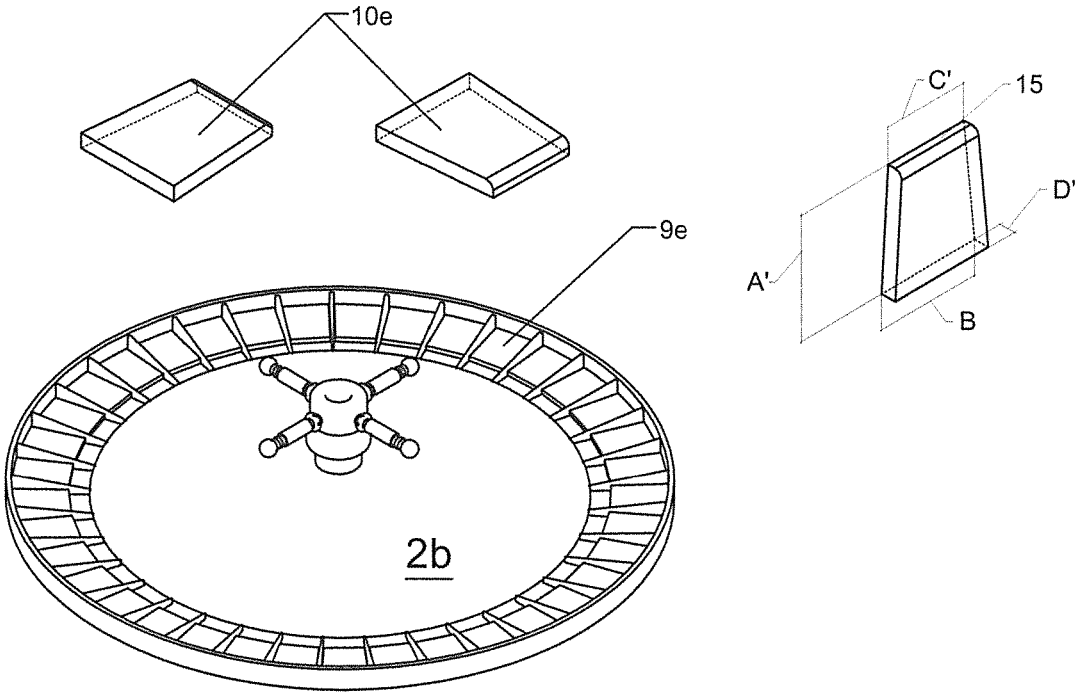
Figure 8:
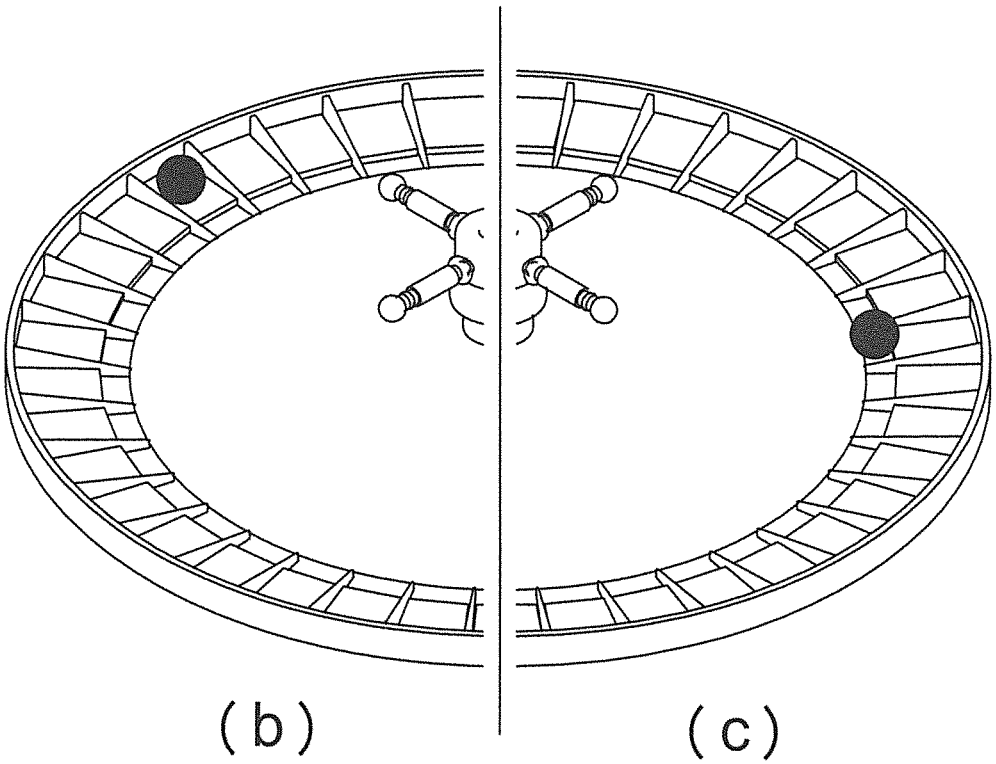
Figure 9:
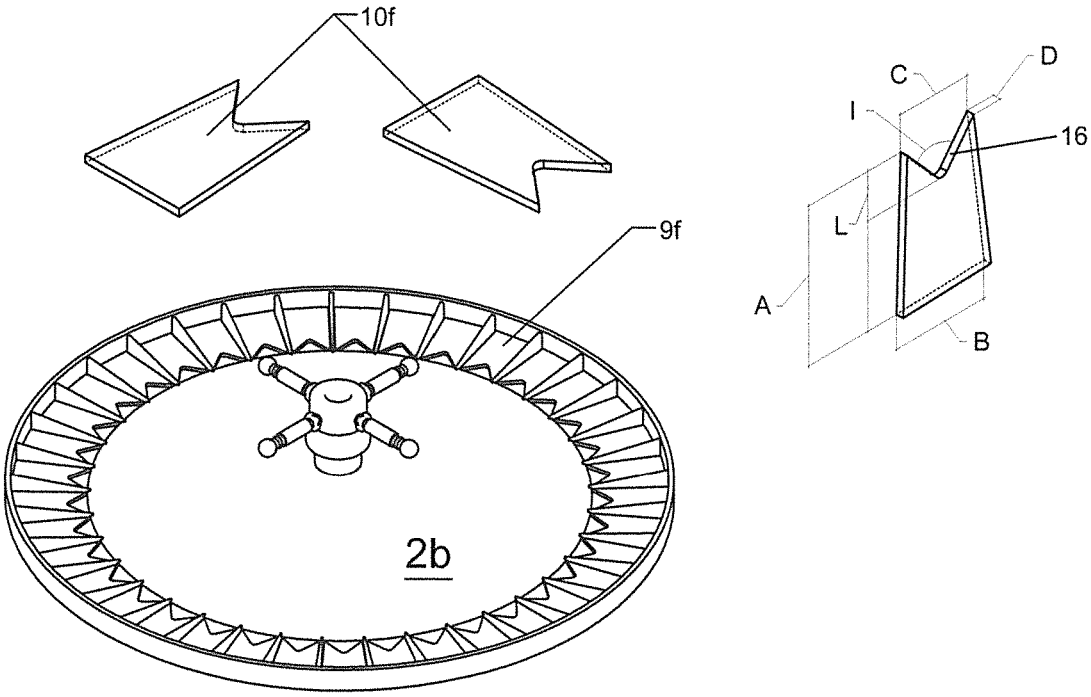
Figure 9:
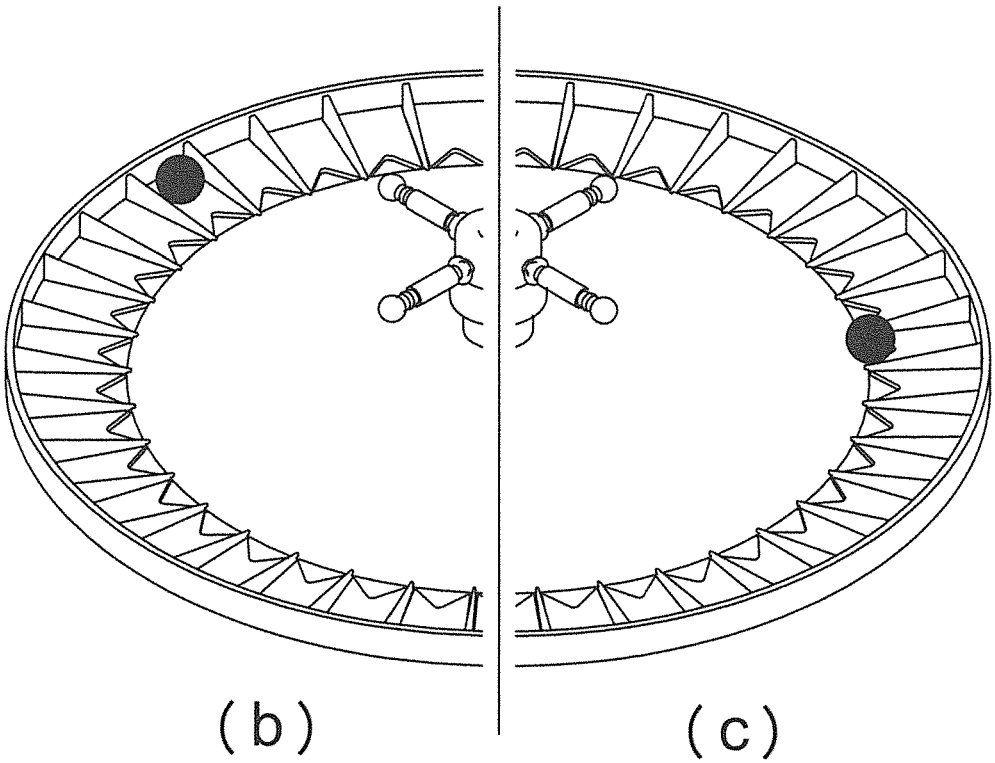
Figure 10:
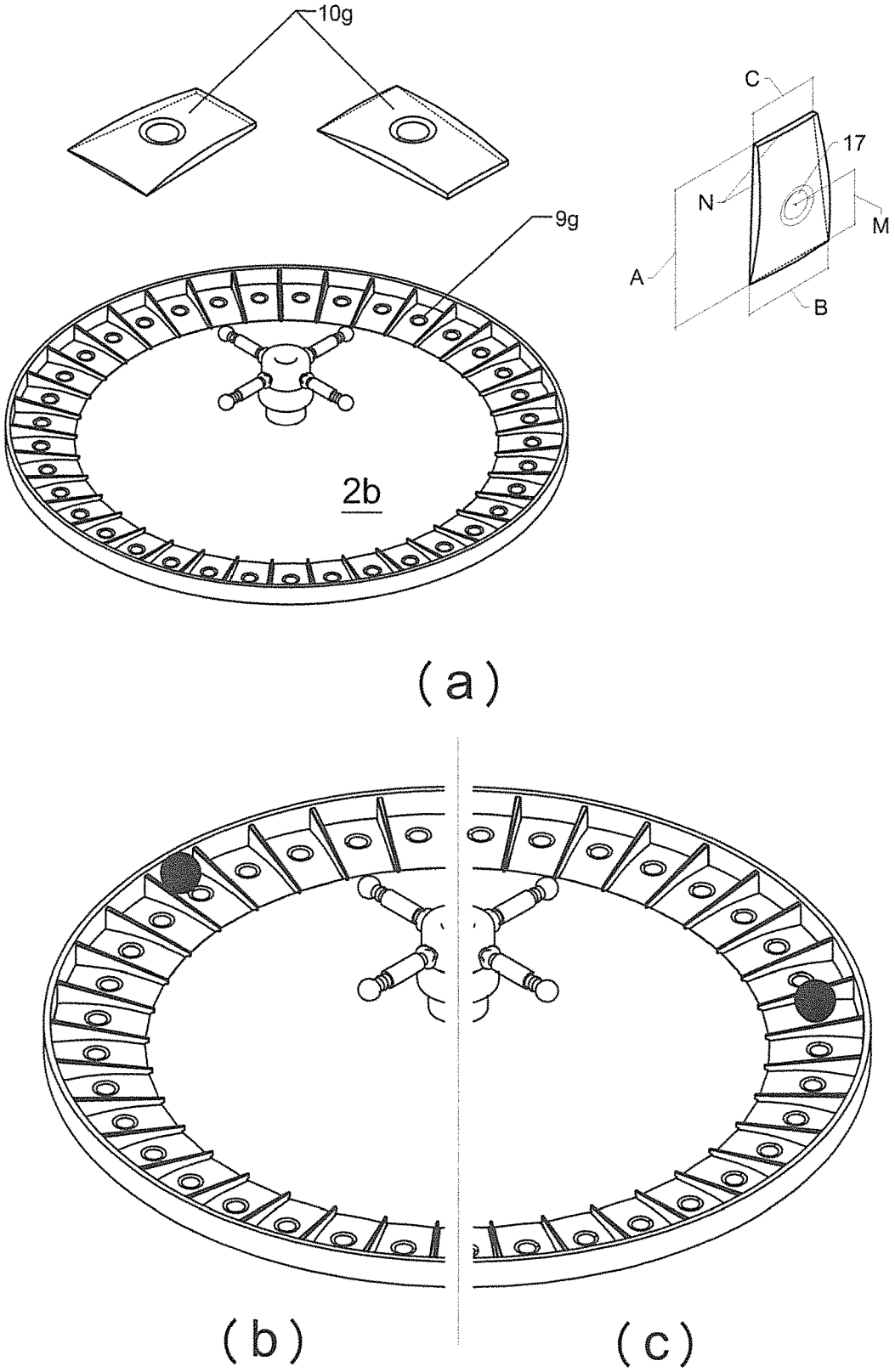
Figure 11:
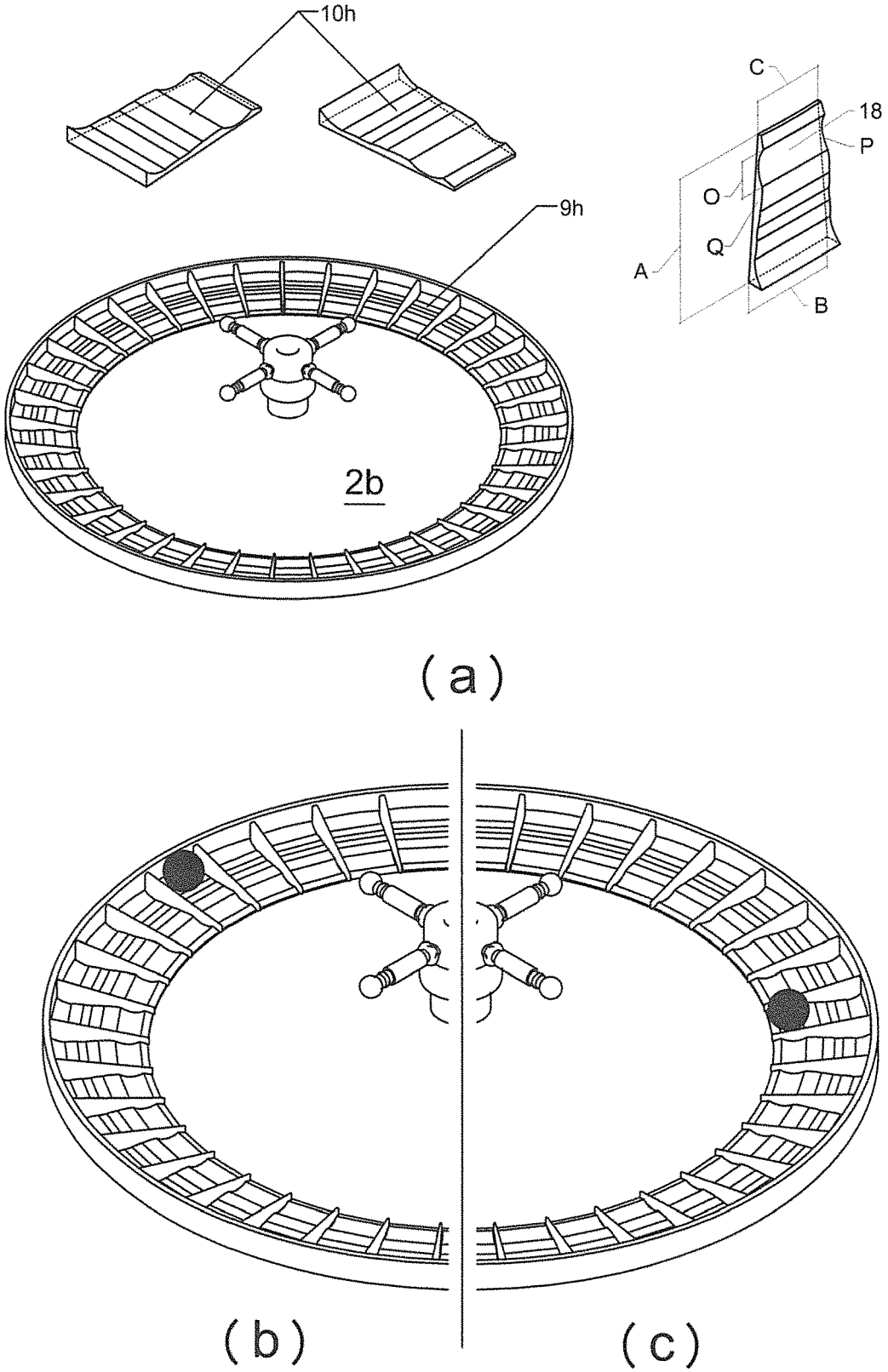
Figure 12:
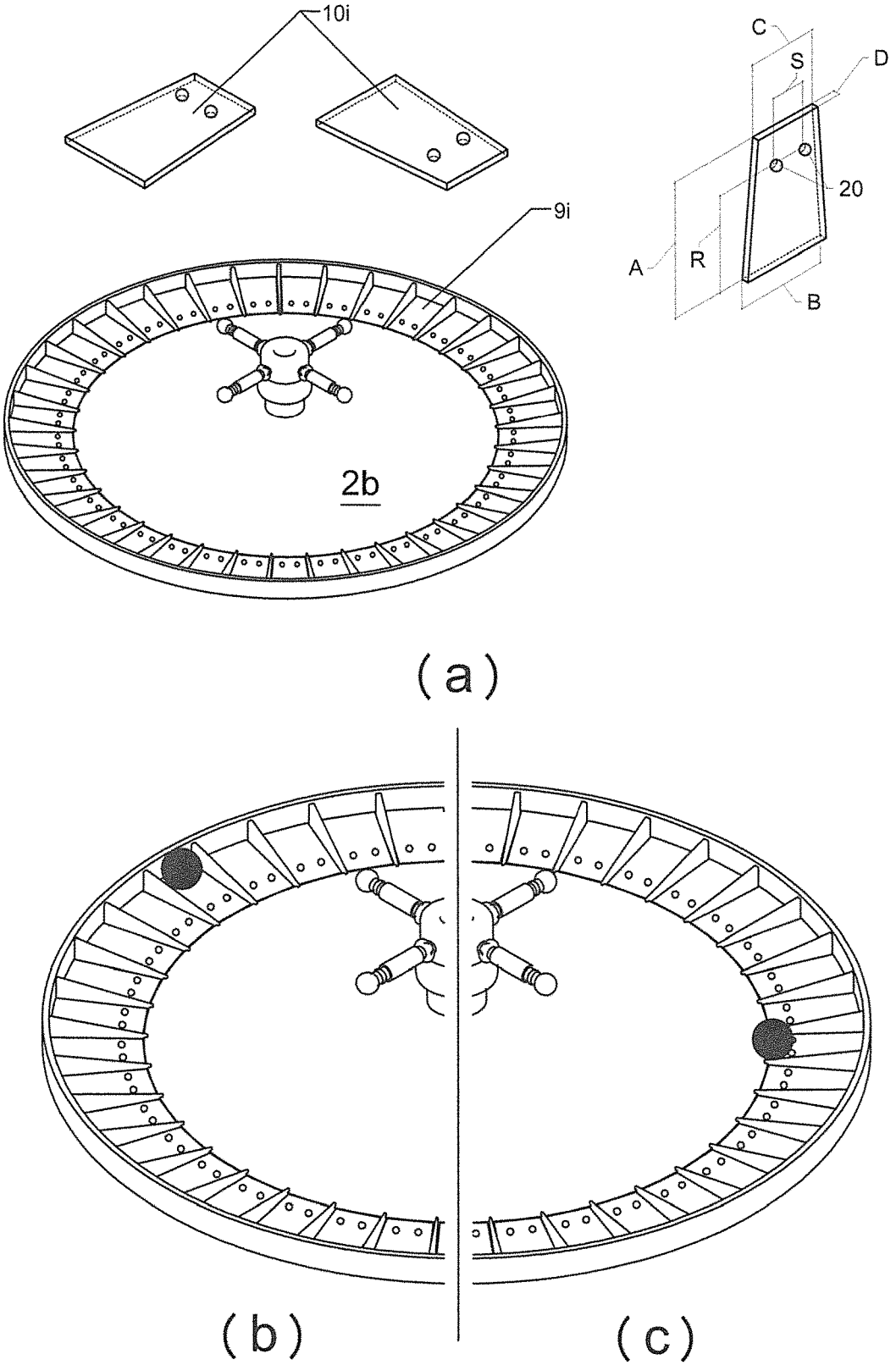
Figure 13:
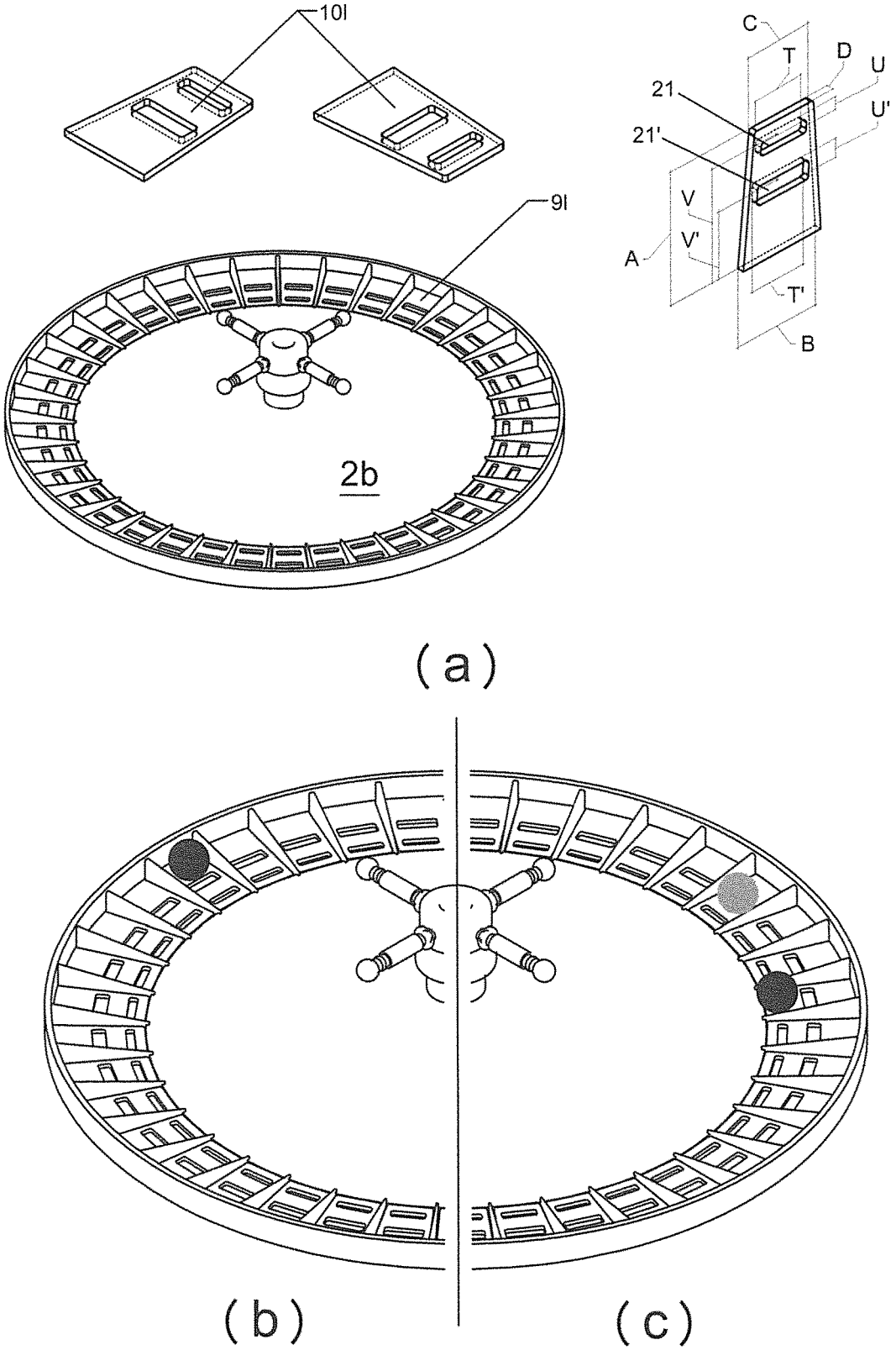

With reference to FIG. 1, (1) designates a game device of a known type, which uses a cylinder. According to a preferred embodiment, this game device (1) is a roulette comprising a cylinder composed of a fixed external part (2*a*), with a concave shape, and an internal part (2*b*), namely a disk rotating around a vertical axis (3), divided into a plurality of numbered sectors. Next to this axis (3) four arms (4) are usually present, arranged as a cross, for checking the speed and the rotation direction of the central disk. These arms (4) can be missing if different means are used (not shown) for impressing a movement to the central disk (2*b*), changing its rotation direction or not.

The game rules provides for launching a ball (5) along a path (track) (6), obtained inside an edge arranged along the circumference of the fixed part (2*a*).

Following the launch, and due to the force of gravity effect, the ball (5) tends to follow a spirally shaped path towards the disk (2*b*) which is rotating. To increase the randomness of the game, along the ball part, obstacles are provided, which are adapted to disturb the natural trajectory of the ball (5), for example inserts in relief (7) having usually the shape of a lozenge.

The disk (2*b*), shown enlarged in FIG. 1*b*, is divided into a plurality of numbered sectors (8), next to each of which there is a box (9) adapted to house the ball (5), which ends its stroke here.

In compliance with a first preferred embodiment of the invention, the object of increasing the number of positions in which the ball (5) can stop inside the boxes (9) is obtained by suitably shaping the bottom of the boxes (9) themselves, in order to locate at least two stopping spots of the ball (5) in each of the boxes (9).

In compliance with a second preferred embodiment of the invention, the object of increasing the number of positions in which the ball (5) can stop inside the boxes (9) is obtained by placing suitable inserts (10) in the boxes (9) themselves, suitable engaging elements being provided, adapted to fasten these inserts (10) inside the boxes (9).

In particular, the inserts (10), though being able to have different shapes, are adapted to be inserted into the boxes (9); for such purpose, they have common features such as maximum values of length (A), width of the lower part, or base (B), width of the upper part, or top (C) and thickness (D), which are defined as function of the shape and size of the boxes (9) present in the moving cylinder (2*b*), in order to be able to be adequately placed inside them.

FIGS. 2 to 13 show inserts (10) and boxes (9) shaped in order to obtain different areas inside the box in which the ball can stop.

The measures mentioned below are compared with a cylinder (2*a*, 2*b*) of a standard type, having a diameter of 800 mm, and a ball (5) having a diameter included between 16 mm and 20 mm; therefore, (A) is included between 30 mm and 60 mm, (B) is included between 20 mm and 40 mm, (C) is included between 20 mm and 30 mm, (D) is included between 0.1 mm and 5 mm.

FIGS. 2*a* and 3*a* show inserts (10*a*, 10*a*') and a few shaping (9*a*, 9*a*') of the boxes (9), which have truncated sections (11, 11'), oriented towards the vertical axis (3), having a curved shape with an amplitude (E) included between 1 mm and 15 mm, and a width (F) included between 5 mm and the maximum width of the upper part (C), so that the ball (5) can stop in two different positions inside the numbered box (9), these two different positions being (i) outside the truncated section (11, 11') (FIGS. 2*b*, 3*b*), or (ii) inside the truncated section (11, 11') (FIGS. 2*c*, 3*c*).

FIGS. 4*a* and 5*a* show inserts (10*b*, 10*b*') and a few shaping (9*b*, 9*b*') of the boxes (9), which have one or more holes (12, 12') having a depth included between 0.1 mm and 3 mm, diameters included between 5 mm and 15 mm and distance (G, G') from the base included between 20 mm and (A)-5 mm so that the ball (5) can stop in different positions inside the numbered box (9), these different positions being (i) outside one of the holes (12, 12') (FIGS. 4*b*, 5*b*), or (ii) inside one of the holes (12, 12') (FIGS. 4*c*, 5*c*).

FIG. 6*a* shows an insert (10*c*), and a shaping (9*c*) of the boxes (9), which have a truncated section (13) of a square shape with an amplitude (H) included between 1 mm and 15 mm and width (I) included between 5 mm and (C) (FIG. 6*a*), so that the ball (5) can stop in two different positions inside the numbered box (9), these two different positions being (i) outside the truncated section (13) (FIG. 6*b*), or (ii) inside the truncated section (13) (FIG. 6*c*).

FIG. 7*a* shows an insert (10*d*), and a shaping (9*d*) of the boxes (9), which have a recess (14) of a diameter included between 5 mm and 15 mm, a depth included between 0.1 mm and 3 mm, and is surrounded by a crown (14') of a width up to 10 mm and a relief included between 0.1 mm and 2 mm, so that the ball (5) can stop in two different positions inside the numbered box (9), these two different positions being (i) outside the recess (14) (FIG. 7*b*), or (ii) inside the recess (14) (FIG. 7*c*).

FIG. 8*a* shows an insert (10*e*), and a shaping (9*e*) of the boxes (9), which have a truncation (15) on the upper part, which is filleted with a radius lower than the insert thickness (D'). The truncation (15) is such that the length (A') can be up to 15 mm lower than the length (A), and the width (C') of the upper part changes consequently. In this way, the ball (5) can stop in two different positions inside the numbered box (9), these two different positions being (i) outside the space left free by this truncation (FIG. 8*b*), or (ii) inside the space left free by this truncation (FIG. 8*c*).

FIG. 9*a* shows an insert (10*f*), and a shaping (9*f*) of the boxes (9), which have a truncated section (16) of a triangular shape with an opening angle (i) included between 30° and 150° and an amplitude (L) included between 1 mm and 15 mm, so that the ball (5) can stop in two different positions inside the numbered box (9), these two different positions being (i) outside the triangular truncated section (16) (FIG. 9*b*), or (ii) inside the triangular truncated section (16) (FIG. 9*c*).

FIG. 10*a* shows an insert (10*g*), and a shaping (9*g*) of the boxes (9), which have a recess (17) of a diameter included between 5 mm and 15 mm for a depth included between 0.1 mm and 3 mm and a distance (M) from the base included between 20 mm and (A), the surface of this insert (10*g*) or of this box (9*g*) being suitably curved to determine a profile (N), so that the ball (5) can stop in two different positions inside the numbered box (9), these two different positions being (i) outside the recess (17) (FIG. 10*b*), or (ii) inside the recess (17) (FIG. 10*c*).

FIG. 11*a* shows an insert (10*h*), and a shaping (9*h*) of the boxes (9), which have a concave section (18) of an amplitude (O) included between 5 mm and 15 mm, a curvature (P) having a depth included between 0.1 mm and 3 mm, the remaining surface with respect to the concave section having different thicknesses with variations included between 0.1 mm and 4 mm, results in a profile (Q), so that the ball (5) can stop in two different positions inside the numbered box (9), these two different positions being (i) outside the concave section (18) (FIG. 11*b*), or (ii) inside the concave section (18) (FIG. 11*c*).

FIG. 12*a* shows an insert (10*i*) and a shaping (9*i*) of the boxes (9) which have inserted therein two spheres (20) horizontally placed at a distance (R) included between 15 mm and (A)-5 mm, placed at a mutual distance (S) included between 3 mm and 10 mm, so that the ball (5) can stop in two different positions inside the numbered box (9), these two different positions being (i) between the spheres (20) and the external edge of the rotatable plate (2*b*) (FIG. 12*b*), or (ii) between the spheres (20) and the internal edge of the rotatable plate (2*b*) (FIG. 12*c*).

FIG. 13*a* shows an insert (101), and a shaping (91) of the boxes (9), which have two engravings (21, 21') of a rectangular shape with a depth included between 0.1 mm and 3 mm, widths (T, T') included between 5 mm and the width of the box (9), amplitudes (U, U') included between 2 mm and 10 mm and placed at distances (V, V') from the base included between 20 mm and (A)-5 mm, so that the ball can stop in different positions inside the numbered box (9), these positions being (i) outside the slots (FIG. 13*b*), or (ii) inside the slots (FIG. 13*c*).

The above inserts (10) can be made of simple or composite materials with a various nature.

By changing the measures (height, length, width, thickness) or the materials used, for the inserts (10) or for the boxes (9), the frequency of the supplementary is affected.

Figure 14:
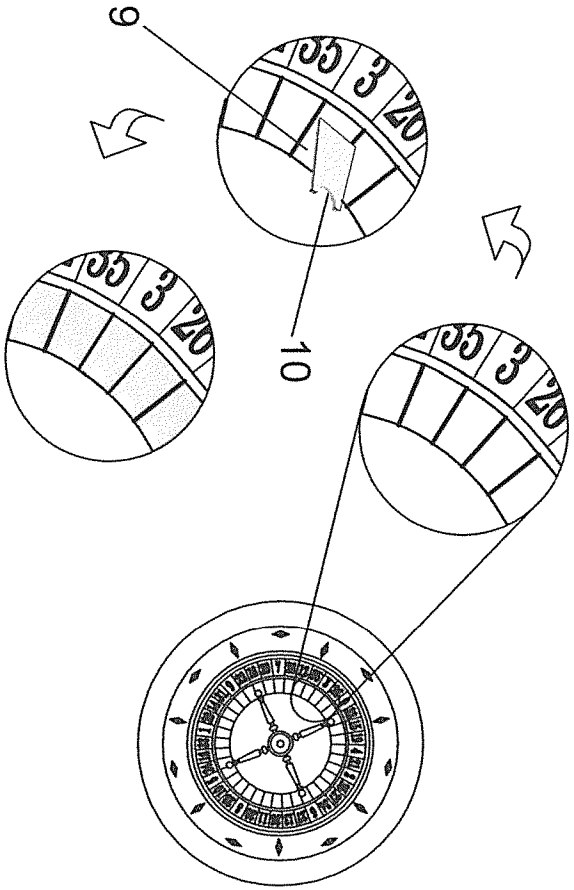
FIG. 14 shows the procedure of introducing an insert in its related box.

The manager of the game environment can autonomously replace the inserts (10) inside the boxes (9), as shown in FIG. 14, and from this develop different game modes.

The shapes of the inserts (10) and of the boxes (9) described can be used also in virtual games, obtaining on each box, always virtually, different areas in which the ball can stop, without changing the procedure of the game itself.

As clearly appears from the previous description, the use of the present invention allows overcoming the probability limits of current roulettes, introducing new game situations, without changing its operation in any way. According to the embodiment which provides for the use of inserts (10), this can be easily adapted also to already existing roulettes.

The invention has been described as a non-limiting example, according to two embodiments thereof. The skilled person can devise numerous other embodiments, all falling within the scope of the enclosed claims.

We claim:

1. A method for increasing a number of possible results which can be obtained with a game device of a roulette type, such increase being with respect to a basic configuration of the game device, wherein a real or virtual ball, at an end of its real or virtual path towards a plurality of numbered boxes of the game device, said numbered boxes prearranged to house the ball, occupies one of the numbered boxes, thereby determining a result, the method comprising the step of adding, inside the numbered boxes, identifiable stop spots where the ball is able to end its stroke, without performing changes to an operation of the game, so that the ball is able to stop in different positions inside one of the numbered boxes.

2. A game device of a roulette type which comprises a first moving part, equipped with a plurality of numbered boxes, adapted to receive a ball, the first moving part rotating inside a second fixed part, so that, by placing the ball on a track of the second fixed part and by launching it towards the first moving part, the ball ends its travel in one of the numbered boxes, thereby determining a winning number, wherein the numbered boxes comprise shaped boxes or suitably shaped inserts adapted to be inserted into the numbered boxes of the game device to provide at least one other stop position of the ball inside the numbered boxes and increase a number of possible results which can be achieved with the game device.

3. The game device of claim 2, wherein the shaped boxes have truncated sections, oriented towards a vertical axis, having a curved shape with an amplitude included between 1 mm and 15 mm, and a width included between 5 mm and a maximum width of an upper part, so that the ball can stop in two different positions inside the numbered box, the two different positions being outside the truncated section, or inside the truncated section.

4. The game device of claim 2, wherein the shaped boxes have one or more holes, so that the ball can stop in different positions inside the numbered box, the different positions being outside one of the holes, or inside one of the holes.

5. The game device of claim 2, wherein the shaped boxes have a truncated section of a square shape, so that the ball can stop in two different positions inside the numbered box, the two different positions being outside the truncated section, or inside the truncated section.

6. The game device of claim 2, wherein the shaped boxes have a recess, and are surrounded by a crown of a width up to 10 mm and a relief included between 0.1 mm and 2 mm, so that the ball can stop in two different positions inside the numbered box, the two different positions being outside the recess, or inside the recess.

7. The game device of claim 2, wherein the shaped boxes have a truncation of the upper part, which is filleted with a radius lower than a thickness of the insert, so that the ball can stop in two different positions inside the numbered box, the two different positions being outside the space left free by the truncation, or inside the space left free by the truncation.

8. The game device of claim 2, wherein the shaped boxes have a truncated section of a triangular shape with an opening angle included between 30° and 150° and amplitude included between 1 mm and 15 mm, so that the ball can stop in two different positions inside the numbered box, the two different positions being outside the triangular truncated section, or inside the triangular truncated section.

9. The game device of claim 2, wherein the shaped boxes have a recess, the surface of the insert or of the box being suitably curved to determine a profile, so that the ball can stop in two different positions inside the numbered box, the two different positions being outside the recess, or inside the recess.

10. The game device of claim 2, wherein the shaped boxes have a concave section of an amplitude included between 5 mm and 15 mm, and a curvature having a depth included between 0.1 mm and 3 mm, the residual surface with respect to the concave section having different thicknesses with variations included between 0.1 mm and 4 mm and resulting in a profile, so that the ball can stop in two different positions inside the numbered box, the two different positions being outside the concave section, or inside the concave section.

11. The game device of claim 2, wherein the shaped boxes have inserted therein two spheres horizontally placed at a distance from the base, placed at a mutual distance included between 3 mm and 10 mm, so that the ball can stop in two different positions inside the numbered box, the two different positions being between the spheres and the external edge of the rotatable plate, or between the spheres and the internal edge of the rotatable plate.

12. The game device of claim 2, wherein the shaped boxes have two engravings comprising slots of a rectangular shape with a depth included between 0.1 mm and 3 mm, widths included between 5 mm and the width of the box, amplitudes included between 2 mm and 10 mm, so that the ball can stop in different positions inside the numbered box, said positions being outside the slots, or inside the slots.

13. The game device of claim 2, wherein the inserts have truncated sections, oriented towards a vertical axis, having a curved shape with an amplitude included between 1 mm and 15 mm, and a width included between 5 mm and a maximum width of an upper part, so that the ball can stop in two different positions inside the numbered box, the two different positions being outside the truncated section, or inside the truncated section.

14. The game device of claim 2, wherein the inserts have one or more holes, so that the ball can stop in different positions inside the numbered box, the different positions being outside one of the holes, or inside one of the holes.

15. The game device of claim 2, wherein the inserts have a truncated section of a square shape, so that the ball can stop in two different positions inside the numbered box, the two different positions being outside the truncated section, or inside the truncated section.

16. The game device of claim 2, wherein the inserts have a recess, and are surrounded by a crown of a width up to 10 mm and a relief included between 0.1 mm and 2 mm, so that the ball can stop in two different positions inside the numbered box, the two different positions being outside the recess, or inside the recess.

17. The game device of claim 2, wherein the inserts have a truncation of the upper part, which is filleted with a radius lower than a thickness of the insert, so that the ball can stop in two different positions inside the numbered box, the two different positions being outside the space left free by the truncation, or inside the space left free by the truncation.

18. The game device of claim 2, wherein the inserts have a truncated section of a triangular shape with an opening angle included between 30° and 150° and amplitude included between 1 mm and 15 mm, so that the ball can stop in two different positions inside the numbered box, the two different positions being outside the triangular truncated section, or inside the triangular truncated section.

19. The game device of claim 2, wherein the inserts have a recess, the surface of the insert or of the box being suitably curved to determine a profile, so that the ball can stop in two different positions inside the numbered box, the two different positions being outside the recess, or inside the recess.

20. The game device of claim 2, wherein the inserts have a concave section of an amplitude included between 5 mm and 15 mm, and a curvature having a depth included between 0.1 mm and 3 mm, the residual surface with respect to the concave section having different thicknesses with variations included between 0.1 mm and 4 mm and resulting in a profile, so that the ball can stop in two different positions inside the numbered box, the two different positions being outside the concave section, or inside the concave section.

21. The game device of claim 2, wherein the inserts have inserted therein two spheres horizontally placed at a distance from the base, placed at a mutual distance included between 3 mm and 10 mm, so that the ball can stop in two different positions inside the numbered box, the two different positions being between the spheres and the external edge of the rotatable plate, or between the spheres and the internal edge of the rotatable plate.

22. The game device of claim 2, wherein the inserts have two engravings comprising slots of a rectangular shape with a depth included between 0.1 mm and 3 mm, widths included between 5 mm and the width of the box, amplitudes included between 2 mm and 10 mm, so that the ball can stop in different positions inside the numbered box, the positions being outside the slots, or inside the slots.

23. A game device of a roulette type which comprises a first moving part, equipped with a plurality of numbered boxes, adapted to receive a ball, the first moving part rotating inside a second fixed part, so that, by placing the ball on a track of the second fixed part and by launching it towards the first moving part, the ball ends its travel in one of the numbered boxes, thereby determining a winning number, wherein the numbered boxes comprise shaped boxes to provide at least one other stop position of the ball inside the numbered boxes;

wherein the shaped boxes:

have one or more holes, so that the ball can stop in different positions inside the numbered box, the different positions being outside one of the holes, or inside one of the holes;

or have a recess, and are surrounded by a crown of a width up to 10 mm and a relief included between 0.1 mm and 2 mm, so that the ball can stop in two different positions inside the numbered box, the two different positions being outside the recess, or inside the recess;

or have a concave section of an amplitude included between 5 mm and 15 mm, and a curvature having a depth included between 0.1 mm and 3 mm, the residual surface with respect to the concave section having different thicknesses with variations included between 0.1 mm and 4 mm and resulting in a profile, so that the ball can stop in two different positions inside the numbered box, the two different positions being outside the concave section, or inside the concave section.

* * * * *